US005941213A

United States Patent [19]

Ishii et al.

[11] Patent Number: 5,941,213

[45] Date of Patent: Aug. 24, 1999

[54] CONTROL SYSTEM FOR INTERNAL COMBUSTION ENGINES

[75] Inventors: Kiyoshi Ishii, Ogawa-machi; Takashi Sasaki, Fujimi; Yasuhiro Urata, Wako; Kazuo Yoshida, Nerima-ku, all of Japan

[73] Assignee: Honda Giken Kogyo Kabushiki Kaisha, Tokyo, Japan

[21] Appl. No.: 08/919,087

[22] Filed: Aug. 27, 1997

[30] Foreign Application Priority Data

Aug. 30, 1996 [JP] Japan ..... 8-246941

[51] Int. Cl.[6] ..... F02D 41/00; F02D 43/04; F02P 5/15

[52] U.S. Cl. ..... 123/406.2; 123/305; 123/406.26; 123/406.45; 123/435

[58] Field of Search ..... 123/305, 406.2, 123/406.26, 406.28, 406.41, 406.45, 435

[56] References Cited

U.S. PATENT DOCUMENTS

| | | | |
|---|---|---|---|
| 4,930,478 | 6/1990 | Plee et al. | 123/435 X |
| 4,976,241 | 12/1990 | Ishida et al. | 123/406.37 |
| 5,067,463 | 11/1991 | Remboski et al. | 123/435 X |
| 5,103,789 | 4/1992 | Hartman et al. | 123/435 |
| 5,113,828 | 5/1992 | Remboski et al. | 123/435 X |
| 5,156,126 | 10/1992 | Ohkubo et al. | 123/435 X |
| 5,738,074 | 4/1998 | Nakamura et al. | 123/435 X |
| 5,765,532 | 6/1998 | Loye | 123/435 |

FOREIGN PATENT DOCUMENTS

| | | |
|---|---|---|
| 61-51650 | 11/1986 | Japan . |
| 3-199651 | 8/1991 | Japan . |

*Primary Examiner*—Tony M. Argenbright
*Attorney, Agent, or Firm*—Frishauf, Holtz, Goodman, Langer & Chick, P.C.

[57] ABSTRACT

A control system for an internal combustion engine includes a heat flux sensor arranged in the combustion chamber of the engine, for detecting the heat flux within the combustion chamber. An ECU controls at least one of the amount of fuel supplied to the engine, the fuel injection timing, and the ignition timing of the engine according to operating conditions of the engine. The heat flux sensor detects the heat flux at timing within a range from the latter half of the exhaust stroke of each of the cylinders of the combustion cycle of the engine to the first half of the compression stroke of the following combustion cycle. At least one of the amount of fuel, the fuel injection timing, and the ignition timing is corrected based on the detected heat flux in the same stroke as the compression stroke of the following combustion cycle in which the heat flux has been detected.

12 Claims, 11 Drawing Sheets

CONTROL SYSTEM FOR INTERNAL COMBUSTION ENGINES

BACKGROUND OF THE INVENTION

1. Field of the Invention

This invention relates to a control system for internal combustion engines, which detects heat flux within the combustion chambers of the engine and controls the combustion efficiency of the engine, based on the detected heat flux.

2. Prior Art

Conventionally, a control system for internal combustion engines is known, for example, from Japanese Laid-Open Patent Publication (Kokai) No. 3-199651, which directly measures the heat amount of gases flowing into a combustion chamber of the engine by a heat flux sensor arranged in the combustion chamber, and estimates a cooling loss from the measured heat amount, to thereby accurately carry out air-fuel ratio control based on the temperature of exhaust gases emitted from the engine.

Further, an internal combustion engine has been proposed, for example, by Japanese Patent Publication (Kokoku) No. 61-51650, in which a sensor for detecting the temperature of a combustion chamber of the engine is mounted in the wall of the combustion chamber, and the maximum allowable value of an amount of fuel supplied into the combustion chamber is changed according to a change in the temperature of the combustion chamber.

Neither of the above-mentioned prior art techniques, however, controls a combustion in the same cycle of the engine as the cycle in which the parameter is detected by the sensor, based on the detected parameter, but they control combustions over several cycles of the engine, based on the detected parameter, i.e. they control the engine combustion on a macro basis. Therefore, the prior art techniques fail to perform so-called micro control that the combustion in the present cycle is controlled in response to an amount of residual gases within the combustion chamber in the last cycle. As a result, the combustion efficiency of the engine cannot be improved with high responsiveness to the actual amount of residual gases within the combustion chamber.

SUMMARY OF THE INVENTION

It is the object of the invention to provide a control system for internal combustion engines, which is capable of improving the combustion efficiency of the engine with high responsiveness to the actual amount of residual gases within the combustion chamber by controlling the combustion in the present cycle in response to the amount of residual gases in the last cycle.

To attain the above object, the invention provides a control system for an internal combustion engine having at least one combustion chamber and a plurality of cylinders, including heat flux-detecting means arranged in the combustion chamber, for detecting heat flux within the combustion chamber, fuel control means for controlling at least one of an amount of fuel supplied to the engine and fuel injection timing according to operating conditions of the engine, and ignition timing control means for controlling ignition timing of the engine according to operating conditions of the engine, the control system being characterized by an improvement wherein:

the heat flux-detecting means detects the heat flux at timing within a range from a latter half of an exhaust stroke of each of the cylinders of a combustion cycle of the engine to a first half of a compression stroke of the each cylinder of a following combustion cycle of the engine; and the control system comprises correcting means for correcting at least one of the amount of fuel controlled by the fuel control means, the fuel injection timing controlled by the fuel control means, and the ignition timing controlled by the ignition timing control means, based on the heat flux detected by the heat flux-detecting means, in the same stroke as the compression stroke of the following combustion cycle in which the heat flux has been detected.

Preferably, the fuel control means sets the fuel injection timing to timing within a crank angle range between 20° before a top dead point corresponding to termination of the compression stroke and 5° after the same.

Preferably, the engine is an internal combustion engine of a type that fuel is directly injected into the combustion chamber, the correcting means comparing the heat flux detected by the heat flux-detecting means with a predetermined value and correcting the amount of fuel, based on results of the comparison.

Also preferably, the engine is an internal combustion engine of a type that fuel is directly injected into the combustion chamber, the correcting means comparing the heat flux detected by the heat flux-detecting means with a predetermined value and correcting the fuel injection timing, based on results of the comparison.

Specifically, the correcting means increases the amount of fuel when the heat flux detected by the heat flux-detecting means is larger than the predetermined value, while the correcting means decreases the amount of fuel when the heat flux detected by the heat flux-detecting means is smaller than the predetermined value.

The correcting means advances the fuel injection timing when the heat flux detected by the heat flux-detecting means is larger than the predetermined value, while the correcting means retards the fuel injection timing when the heat flux detected by the heat flux-detecting means is smaller than the predetermined value.

The correcting means advances the ignition timing when the heat flux detected by the heat flux-detecting means is larger than a predetermined value, while the correcting means retards the ignition timing when the heat flux detected by the heat flux-detecting means is smaller than a predetermined value.

The above and other objects, features and advantages of the invention will be more apparent from the following detailed description taken in conjunction with the accompanying drawings.

DETAILED DESCRIPTION

The invention will now be described in detail with reference to the drawings showing embodiments thereof.

Figure 1:
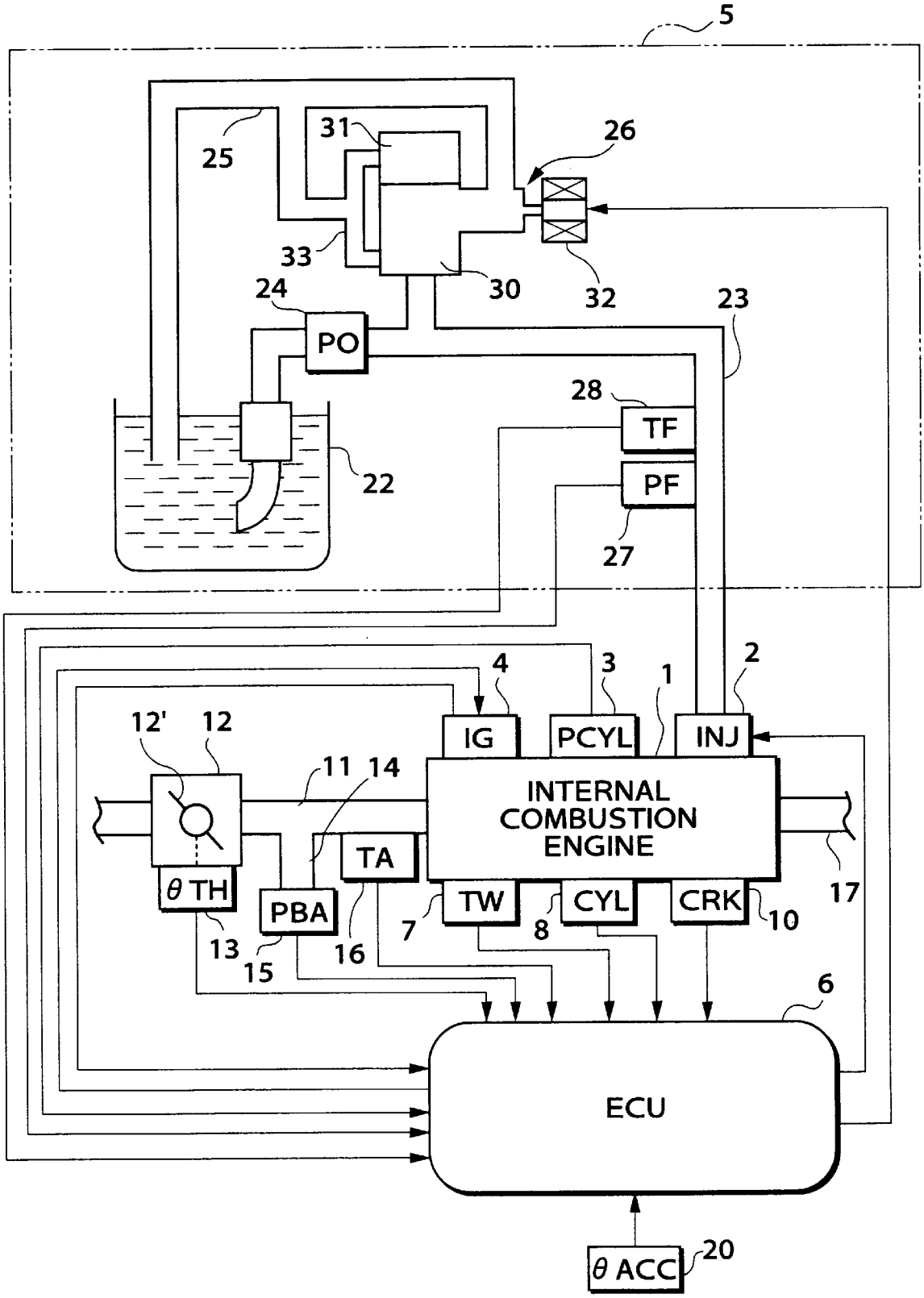
FIG. 1 is a block diagram showing the whole arrangement of an internal combustion engine and a control system therefor, according to an embodiment of the invention.

Referring first to FIG. 1, there is shown the whole arrangement of an internal combustion engine and a control system therefor, according to a first embodiment of the invention.

In the figure, reference numeral 1 designates a cylinder direct injection-type internal combustion engine (hereinafter simply referred to as "the engine") having four cylinders. The cylinders each have a cylinder head in which are arranged a fuel injection valve (INJ) 2, a cylinder pressure (PCYL) sensor 3, a spark plug (IG) 4, intake valves, not shown, and exhaust valves, not shown, at respective predetermined positions.

The fuel injection valves 2, only one of which is shown, is connected to a fuel supply system 5 of the engine, and electrically connected to an electronic control unit (hereinafter referred to as "the ECU") 6, to have their valve opening periods controlled by signals from the ECU 6.

The PCYL sensor 3 is electrically connected to the ECU 6, for supplying an electric signal indicative of the sensed pressure within the cylinder (PCYL) to the ECU 6.

The spark plug 4 is electrically connected to the ECU 6 to have ignition timing thereof controlled by a signal from the ECU 6. The spark plug 4 has embedded therein a heat flux sensor 18 formed of a thin film thermocouple, which is electrically connected to the ECU 6, for supplying an electric signal indicative of the sensed heat flux to the ECU 6.

Figure 4B:
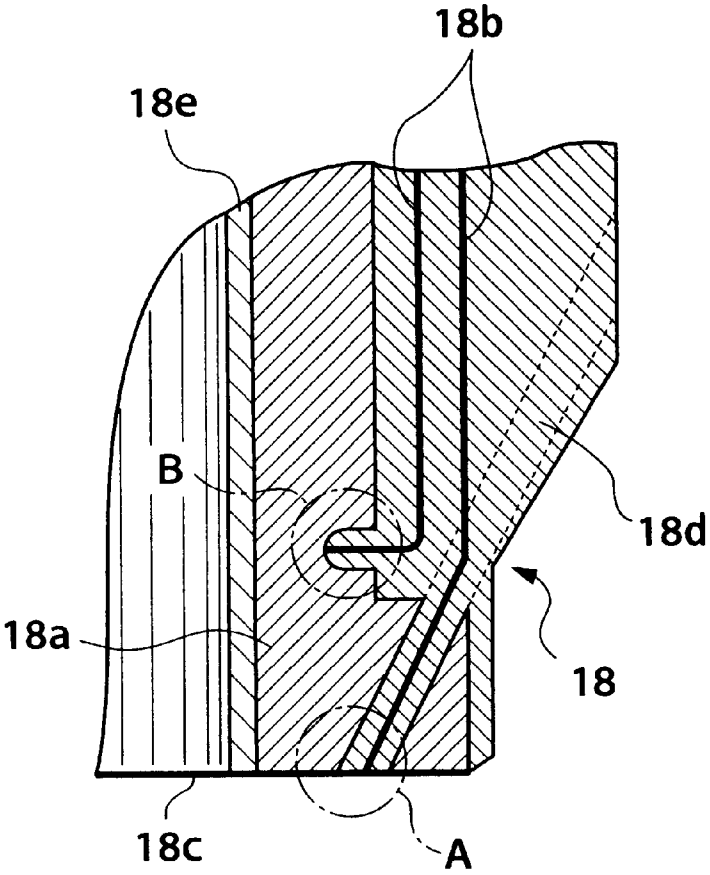
FIG. 4B is a fragmentary sectional view of a part of the spark plug of FIG. 4A on an enlarged scale.
Figure 4A:
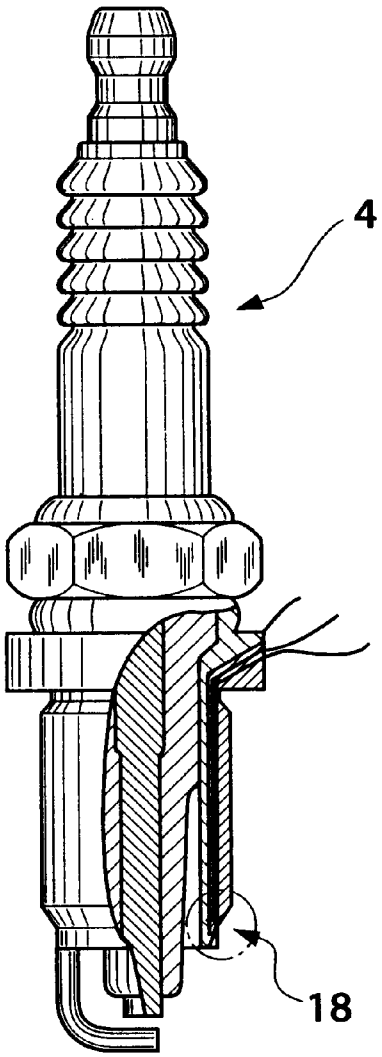
FIG. 4A is a view, partly in section, showing the whole construction of a spark plug appearing in FIG. 1.

FIGS. 4A and 4B show the construction of the spark plug 4, in which FIG. 4A shows the whole construction of the spark plug 4, and FIG. 4B shows on an enlarged scale a tip portion of the spark plug 4 which is encircled by a broken line in FIG. 4A. Formed at the tip of a threaded portion of the spark plug 4 is a hot junction A by connecting between an iron-based alloy material forming the threaded portion 18*a* and an end of one of two constantan wires 18*b* having a diameter of 100 μm by means of a copper plate film 18*c* having a thickness of 10 μm coated over a tip surface of the threaded portion 18*a*. Further, a cold junction B is formed in the threaded portion 18*a* at an end of the other constantan wire 18*b* at a distance of 3 mm from the tip surface of the threaded portion 18*a*. Heat insulation materials 18*d*, 18*e* are applied on opposite sides of the threaded portion 18*a* at a region where the hot junction A and the cold junction B are formed. The other ends of the constantan wires 18*b* are connected to output terminals, not shown, of the sensor 18. It is assumed that a unidimensional heat flow occurs in the axial direction of the spark plug 4 from the hot junction A to the cold junction B, and heat flux is detected based on the difference in temperature between the junctions A and B. An electric signal indicative of the sensed heat flux is supplied to the ECU 6, as mentioned above.

An engine coolant temperature (TW) sensor 7 formed of a thermistor or the like is inserted into a coolant passage filled with an engine coolant and formed in the cylinder block of the engine 1, for detecting the temperature TW of the engine coolant and supplying an electric signal indicative of the sensed engine coolant temperature TW to the ECU 6.

A cylinder-discriminating (CYL) sensor 8 and a crank angle (CRK) sensor 10 are arranged in facing relation to a camshaft or a crankshaft of the engine 1, neither of which is shown, at respective predetermined locations.

The CYL sensor 8 generates a signal pulse (hereinafter referred to as ("CYL signal pulse") at a predetermined crank angle of a particular cylinder of the engine 1 whenever the crankshaft rotates two rotations, the CYL signal pulse being supplied to the ECU 6.

The CRK sensor 10 generates a signal pulse (hereinafter referred to as "CRK signal pulse") whenever the crankshaft rotates through a predetermined very small crank angle (e.g. 1°), the CRK signal pulse being supplied to the ECU 6.

The engine has an intake pipe 11 connected to each cylinder. Arranged across the intake pipe 2 is a throttle body 12 accommodating therein a throttle valve 12'. A throttle valve opening (θTH) sensor 13 is connected to the throttle valve 12', for generating an electric signal indicative of the sensed throttle valve opening θTH to the ECU 6.

An intake pipe absolute pressure (PBA) sensor 15 is communicated via a conduit 14 to the intake pipe 11 at a location immediately downstream of the throttle valve 12', for sensing absolute pressure PBA within the intake pipe 2, and is electrically connected to the ECU 6, for supplying a signal indicative of the sensed absolute pressure PBA to the ECU 6.

An intake air temperature (TA) sensor 16 is inserted into the intake pipe 11 at a location downstream of the conduit 14, for supplying an electric signal indicative of the sensed intake air temperature TA to the ECU 6.

An accelerator pedal position (θACC) sensor 20 is connected to an accelerator pedal, not shown, of a vehicle in which the engine 1 is installed, for detecting a stepping-on amount θACC of the accelerator pedal. An electric signal indicative of the sensed stepping-on amount θACC is supplied to the ECU 6.

Referring again to the fuel supply system 5, a fuel pump (PO) 24 is arranged across a fuel supply passage 23 extending between the fuel injection valve 2 and a fuel tank 22. Further, a bypass passage 25 branches off from the fuel supply passage 23 at a location downstream of the fuel pump 24, and extends to the fuel tank 22. The bypass passage 25 has a fuel pressure control valve (hereinafter referred to as "the EPR valve") 26 arranged thereacross.

A fuel pressure (PF) sensor 27 is connected to the fuel supply passage 23 at a location slightly upstream of the fuel injection valve 2. The PF sensor 27 is electrically connected to the ECU 6, for supplying an electric signal indicative of the sensed fuel pressure PF within the fuel supply passage 23 to the ECU 6.

Further connected to the fuel supply passage 23 is a fuel temperature (TF) sensor 28 which may be formed of a thermistor or the like, at a location immediately upstream of the PF sensor 27. The TF sensor 28 is electrically connected to the ECU 6, for supplying a signal indicative of the sensed fuel temperature TF within the fuel supply passage 23 to the ECU 6.

Figure 2:
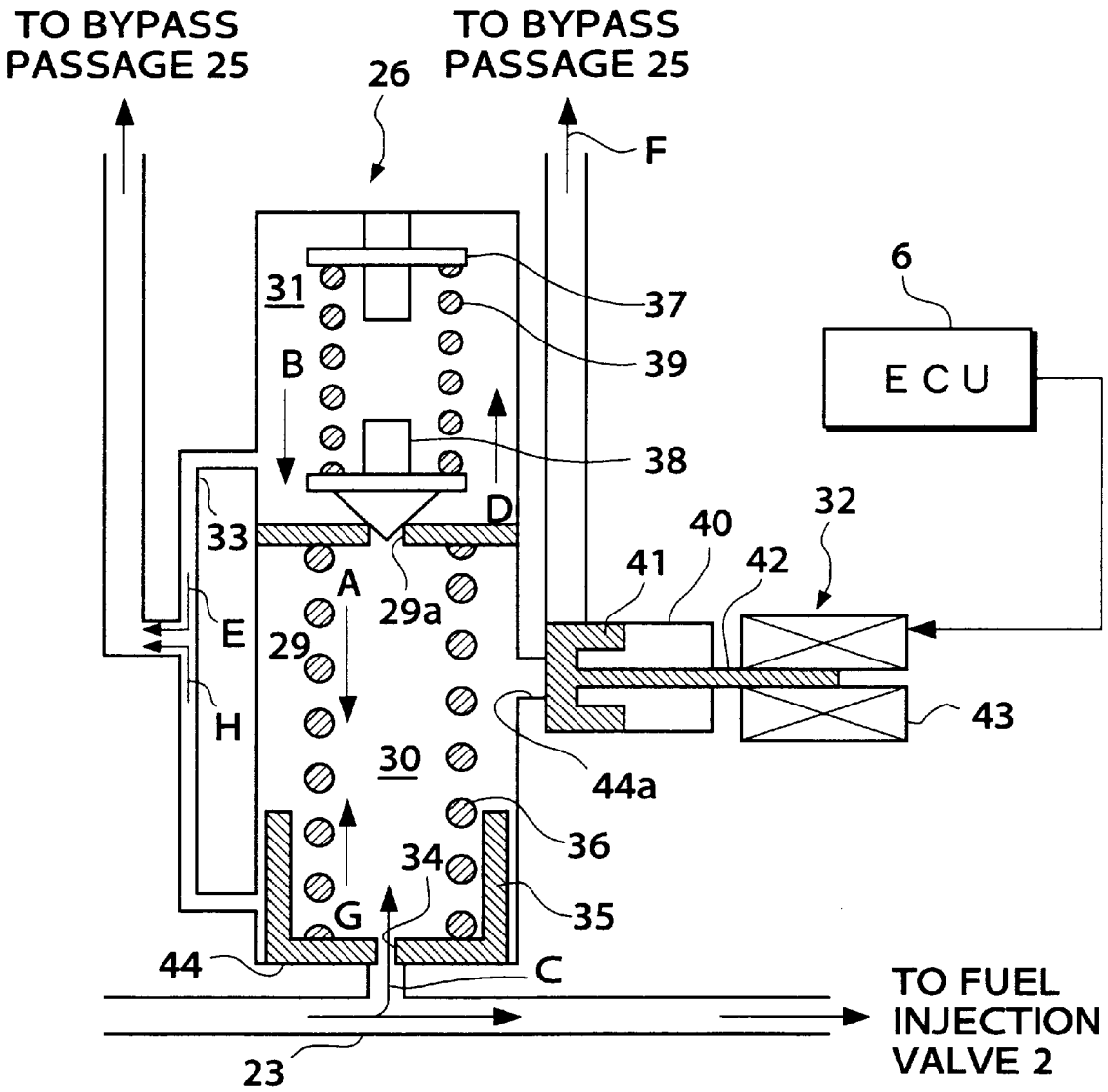
FIG. 2 is a sectional view showing the construction of a fuel pressure control (EPR) valve appearing in FIG. 1.

FIG. 2 shows the construction of the EPR valve 26. The EPR valve 26 includes a casing 44 having a first valve chamber 30 and a second valve chamber 31 defined therein by a partition member 29. Further, the first chamber 30 has a side wall through which an electromagnetic valve 32 is connected to the first chamber 30.

The first and second valve chambers 30 and 31 are communicated with each other via a T-shaped conduit 33 extending to the bypass passage 25.

The first valve chamber 30 accommodates a main valve comprised of a valve element 35 having a U-shaped cross section and formed with a restriction 34 at an almost central portion thereof, and a spring 36 interposed between the valve element 35 and the partition member 29, for biasing the valve element 35 in a direction indicated by an arrow A.

The second valve chamber 31 accommodates a relief valve comprised of a spring seat 37 vertically suspended from a top wall of the casing 44, a valve element 38 having a cone-shaped tip and disposed for line contact with a through hole 29*a* formed in the partition member 29, and a spring 39 interposed between the valve element 38 and the spring seat 37, for biasing the valve element 38 in a direction indicated by an arrow B.

The electromagnetic valve 32 is comprised of a valve casing 40, a valve element 41 having a generally U-shaped cross section, accommodated in the valve casing 40 so as to open and close through a hole 44*a* formed in the side wall of the casing 44 to thereby communicate the interior of the casing 44 with the bypass passage 25, and a solenoid 43 drivingly connected to the valve element via a rod 42.

The EPR valve constructed as above operates as follows: Fuel supplied from the fuel pump 24 flows through the restriction 34 of the valve element 35 of the main valve into the first valve chamber 30 in a direction indicated by an arrow C, whereby the pressure of the supplied fuel acts as back pressure on the valve element 35. When the electromagnetic valve 32 is energized to close, the back pressure rises to cooperate with the biasing force of the spring 36 to close a gap between the valve element 35 and the casing 44. Accordingly, the fuel from the fuel pump 24 does not leak to the bypass passage 25, so that the fuel pressure PF of fuel supplied to the fuel injection valve 2 increases.

When the pressure within the first valve chamber 30 becomes equal to a valve opening pressure value (e.g. 150 to 200 kg/cm$^2$ or more) of the relief valve, the valve element 38 of the relief valve moves in a direction indicated by an arrow D against the biasing force of the spring 39, whereby the fuel flows into the conduit 33 as indicated by an arrow E to be returned through the bypass passage 25 to the fuel tank 22.

On the other hand, when the electromagnetic valve 32 is deenergized to open, fuel in the first valve chamber 30 flows through the hole 44*a* and along the valve casing 40 to the bypass passage 25, as indicated by an arrow F. Accordingly, the back pressure applied on the valve element 35 lowers to move the same in a direction indicated by an arrow G against the biasing force of the spring 36. Therefore, the back pressure leaks via the gap between the valve element 35 and the casing 44, whereby fuel flows into the conduit 33 as indicated by an arrow H to return to the bypass passage 25, to thereby reduce the fuel pressure PF of fuel supplied to the fuel injection valve 2. The electromagnetic valve 32 is opened and closed with a duty ratio based on a command signal from the ECU 6, which is determined according to a load condition of the engine so that the fuel pressure PF of fuel supplied from the fuel tank 22 to the fuel injection valve 2 is controlled to a desired value.

Figure 3:
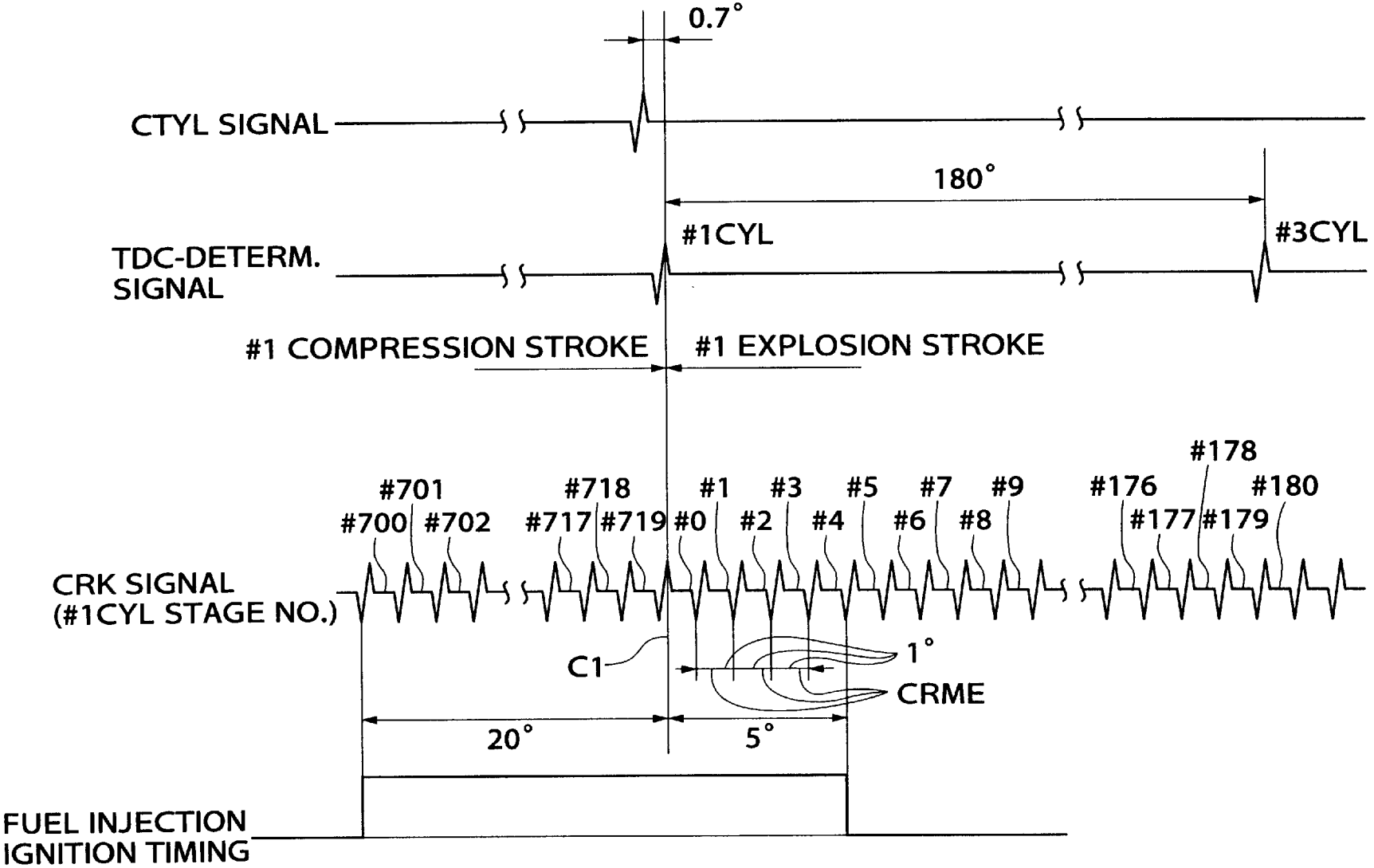
FIG. 3 is a timing chart showing the relationship in generation timing between a CYL signal, a TDC-determining signal, and a CRK signal, as well as fuel injection timing.

FIG. 3 shows the relationship in generation timings between the CYL signal pulse from the CYL sensor 8, a TDC-determining signal pulse, referred to hereinafter, and the CRK signal pulse from the CRK sensor 10, as well as the fuel injection timing.

CRK signal pulses are generated at predetermined crank angles whenever the crankshaft rotates, e.g. one degree, and hence in the present embodiment, 720 CRK signal pulses are generated over two rotations of the crankshaft.

The ECU 6 counts the number of CRK signal pulses, and whenever 180 CRK signal pulses are counted (whenever the crankshaft rotates through 180 degrees), the ECU 6 generates a TDC-determining signal pulse, to thereby detect a reference crank angle position of each cylinder. Further, the ECU 6 measures a time interval CRME over which adjacent CRK signal pulses are generated, and adds CRME values over a time interval of generation of TDC-determining signal pulses to calculate the sum of the CRME values as an ME value. Thus, the rotational speed NE of the engine is detected from the reciprocal of the ME value.

A CYL signal pulse is generated at a predetermined crank angle (e.g. at 0.7° BTDC) immediately before a position of generation of a TDC-determining signal pulse corresponding to termination of the compression stroke of a particular cylinder (e.g. #1CYL), and the particular cylinder number (e.g. #1CYL) is set upon generation of a TDC-determining signal pulse generated immediately after the generation of the CYL signal pulse.

Further, the ECU 6 detects crank angle stages (hereinafter referred to as "the stage") with respect to the reference crank angle position of each cylinder, based on a TDC-determining signal pulse and CRK signal pulses. More specifically, when a CRK signal pulse C1 detected at the same time with generation of a TDC-determining signal pulse is generated at a TDC position corresponding to the termination of the compression stroke, the ECU 6 detects a #0 stage of the cylinder #1CYL, based on the CRK signal pulse C1, and then sequentially detects a #1 stage, a #2 stage, . . . , a #719 stage in response to CRK signal pulses generated thereafter.

The fuel injection timing is set to timing within a predetermined crank angle range in which good exhaust emission characteristics of the engine are obtained and desired stratified combustion can take place within the combustion chamber in every load region of the engine, and more specifically, it is set to timing within a range between 20° before the TDC position corresponding to the termination of the compression stroke (BTDC 20°) and 5° after the same (ATDC 5°)

Figure 5:
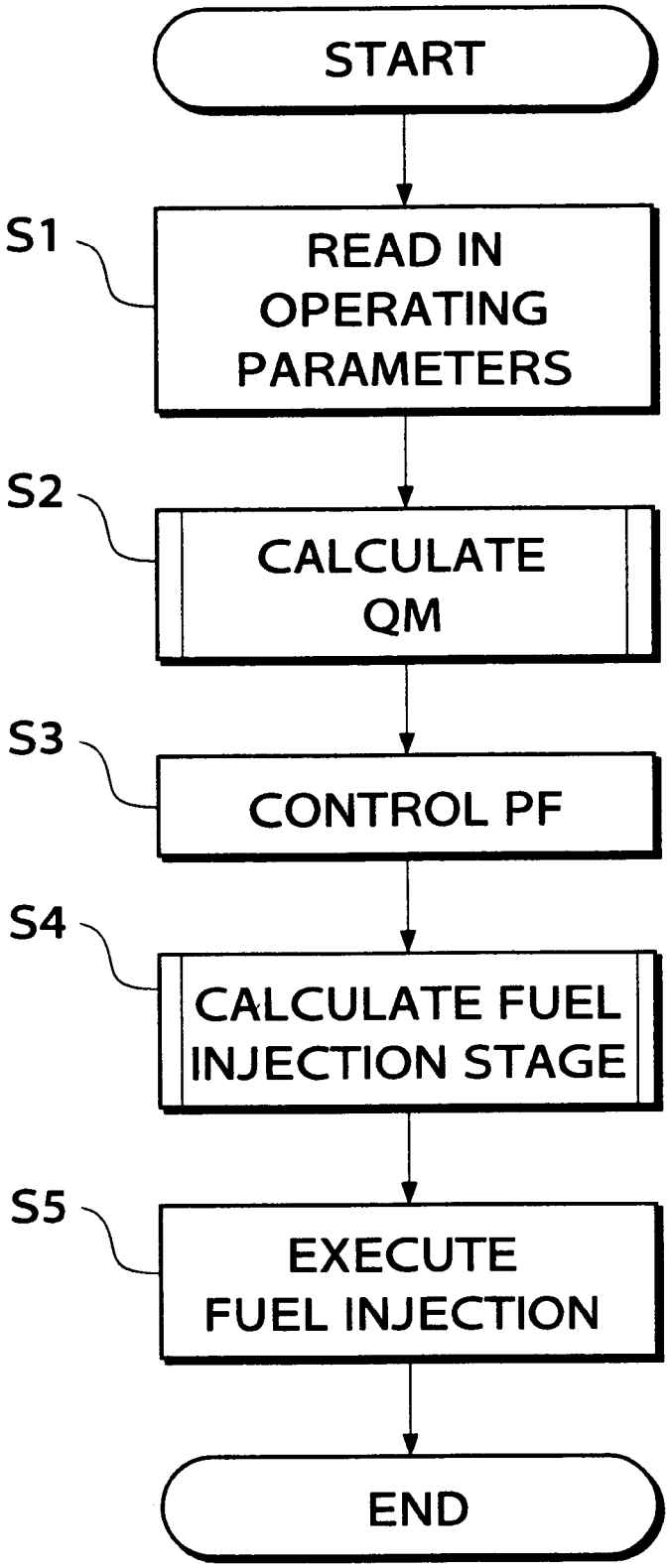
FIG. 5 is a flowchart showing a main routine for carrying out fuel injection control, which is executed by an ECU appearing in FIG. 1.

FIG. 5 shows a main routine for carrying out fuel injection control, which is executed by the ECU 6. This program is started in the latter half of the exhaust stroke of each cylinder. First, at a step S1, the ECU 6 reads in operating parameters of the engine from various sensors including those mentioned as above. Then, at a step S2, a desired fuel injection amount QM is calculated according to predetermined ones of the read engine operating parameters. The manner of calculation of the desired fuel injection amount QM will be described hereinafter.

At a step S3, a desired fuel pressure PFM is determined according to predetermined ones of the read engine operating parameters, and the actual fuel pressure PF of fuel supplied to the fuel injection valve 2 is feedback-controlled via the EPR valve 26 such that the fuel pressure PF becomes equal to the desired fuel pressure PFM. Then, an injection stage at which the fuel injection is to be started is calculated according to predetermined ones of the engine operating parameters at a step S4. Then, the fuel injection is started at the calculated injection stage, and timing of termination of the fuel injection is controlled such that the fuel injection amount becomes equal to the desired fuel injection amount QM at a step S5, followed by terminating the program.

Figure 6:
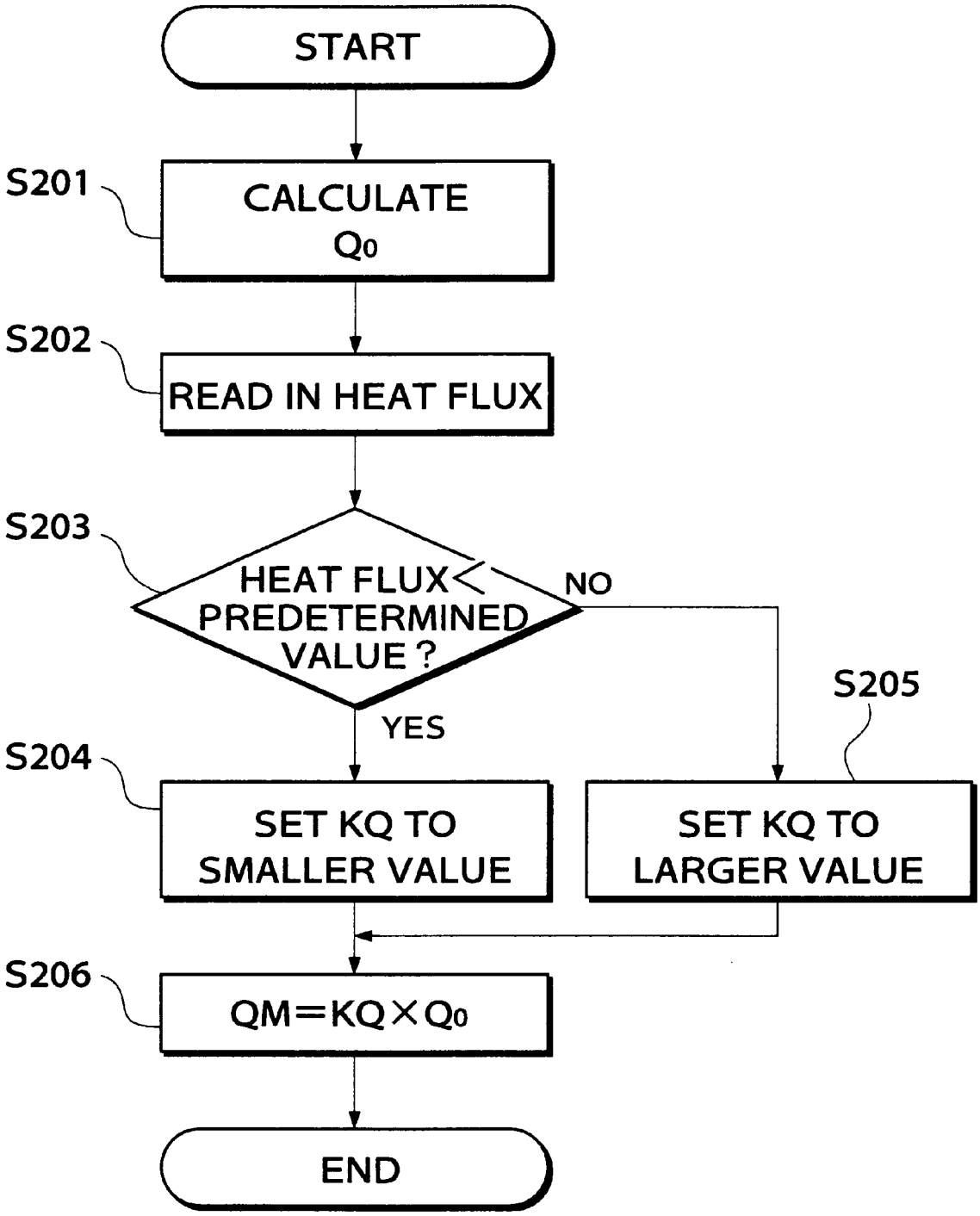
FIG. 6 is a flowchart showing a subroutine for calculating a desired fuel injection amount QM, which is executed at a step S2 in FIG. 5.

FIG. 6 shows a subroutine for calculating the desired fuel injection amount QM, which is executed at the step S2 in FIG. 5.

Figure 7:
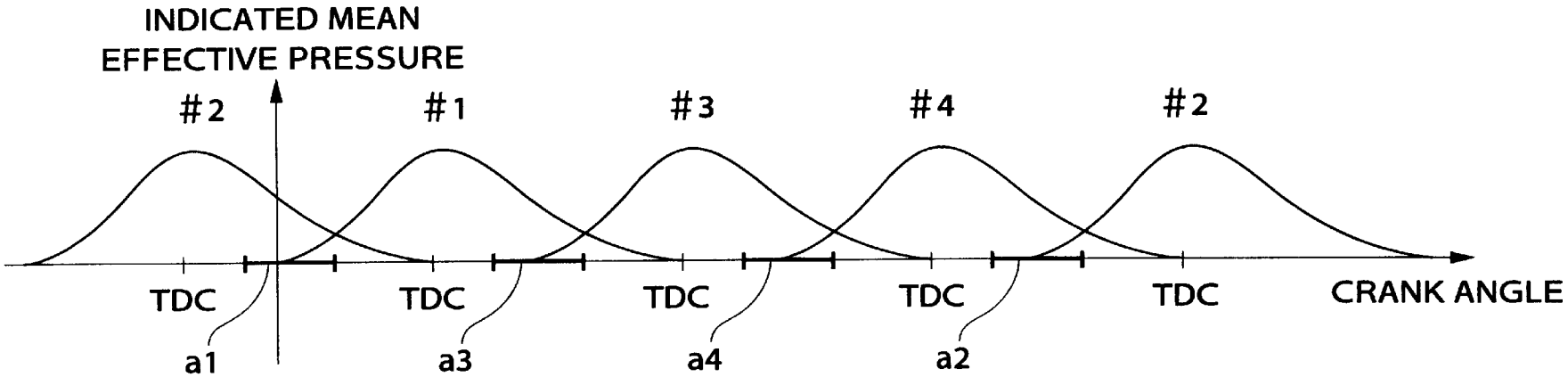
FIG. 7 is a timing chart showing timing of calculating the desired fuel injection amount QM to be supplied to each cylinder of the engine.

FIG. 7 shows the timing of calculating the desired fuel injection amount QM. When the engine is of the four-cylinder type, combustion takes place in the order of the cylinders of #2, #1, #3, #4, and #2 . . . . The desired fuel injection amount QM which is directly injected into each cylinder in the compression stroke thereof is calculated based on the heat flux detected in a crank angle range between the latter half of the exhaust stroke of the last operating (combustion) cycle and the first half of the compression stroke of the present operating cycle (e.g. crank angle ranges, a1, a3, a4, a2 in FIG. 7).

Referring again to FIG. 6, first, the ECU 6 determines a basic fuel injection amount Q0 from a Q0 map, not shown, at a step S201. The Q0 map is provided with map values of the basic fuel injection amount Q0 arranged in the form of a matrix, according to predetermined values of the engine rotational speed NE detected by the CRK sensor 10 and predetermined values of an engine operating parameter indicative of the load on the engine (e.g. accelerator pedal position θACC detected by the θACC sensor 20 and the intake pipe absolute pressure PBA detected by the PBA sensor 15). The basic fuel injection amount Q0 is set to a larger value as the engine rotational speed NE becomes higher and/or the load on the engine becomes larger. Alternatively, the basic fuel injection amount Q0 may be calculated by another routine executed in synchronism with generation of TDC-determining signal pulses, by reading a Q0 value from a memory in which Q0 values are stored beforehand. The ECU 6 may use the thus stored basic fuel injection amount in place of the determination of the same from the Q0 map.

Then, a value of the heat flux is detected by the heat flux sensor 18 and read in, in synchronism with generation of a CRK signal pulse at one of the predetermined crank angle stages within the abovementioned crank angle range at a step S202. Then, it is determined at a step S203 whether or not the read heat flux value is smaller than a predetermined value. If the heat flux value is smaller than the predetermined value, an injection amount correction coefficient KQ is set to a smaller value to decrease the fuel injection amount at a step S204. On the other hand, if the heat flux value is larger than the predetermined value, the injection amount correction coefficient KQ is set to a larger value at a step S205. As the predetermined value to be compared with the read heat flux value, it is preferable to use an average value of the heat flux which has been detected by a test, etc, since the average value reflects peculiar characteristics of the engine.

Figure 9:
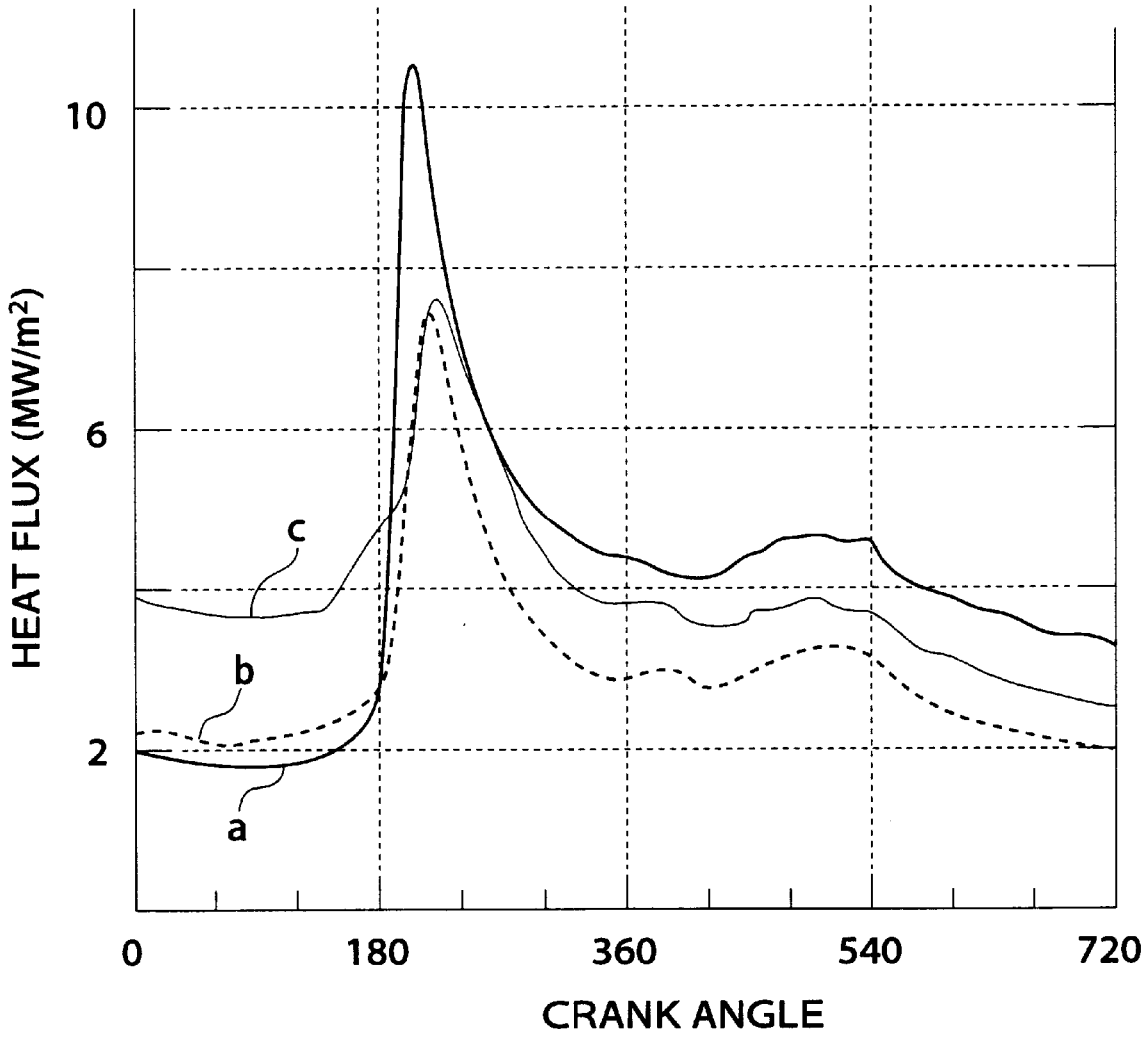
FIG. 9 is a graph showing characteristics of heat flux relative to the crank angle.

FIG. 9 shows changes in the heat flux relative to the crank angle. In the figure, a broken line b indicates an average value of the heat flux which has been detected by a test. When the detected heat flux is smaller than the average value b, as indicated by a thick solid line a, it is assumed that residual gases have been all burned in the last combustion cycle within the combustion chamber, so that the indicated mean effective pressure becomes high during the present combustion cycle, and hence good combustion efficiency is obtained. On the other hand, when the detected heat flux is larger than the average value b, as indicated by a thin solid line c, it is assumed that a large amount of residual gases which have not been burned in the last combustion cycle remains within the combustion chamber, so that the indicated mean effective pressure becomes low during the present combustion cycle, and hence the combustion efficiency is degraded.

Referring again to FIG. 6, after the injection amount correction coefficient KQ has been calculated either at the step 204 or the step S205, the ECU 6 calculates the desired fuel injection amount QM by multiplying the basic fuel injection amount Q0 by the injection amount correction coefficient KQ at a step S206, followed by terminating the present routine:

$$QM=KQ\times Q0 \quad (1)$$

Figure 8:
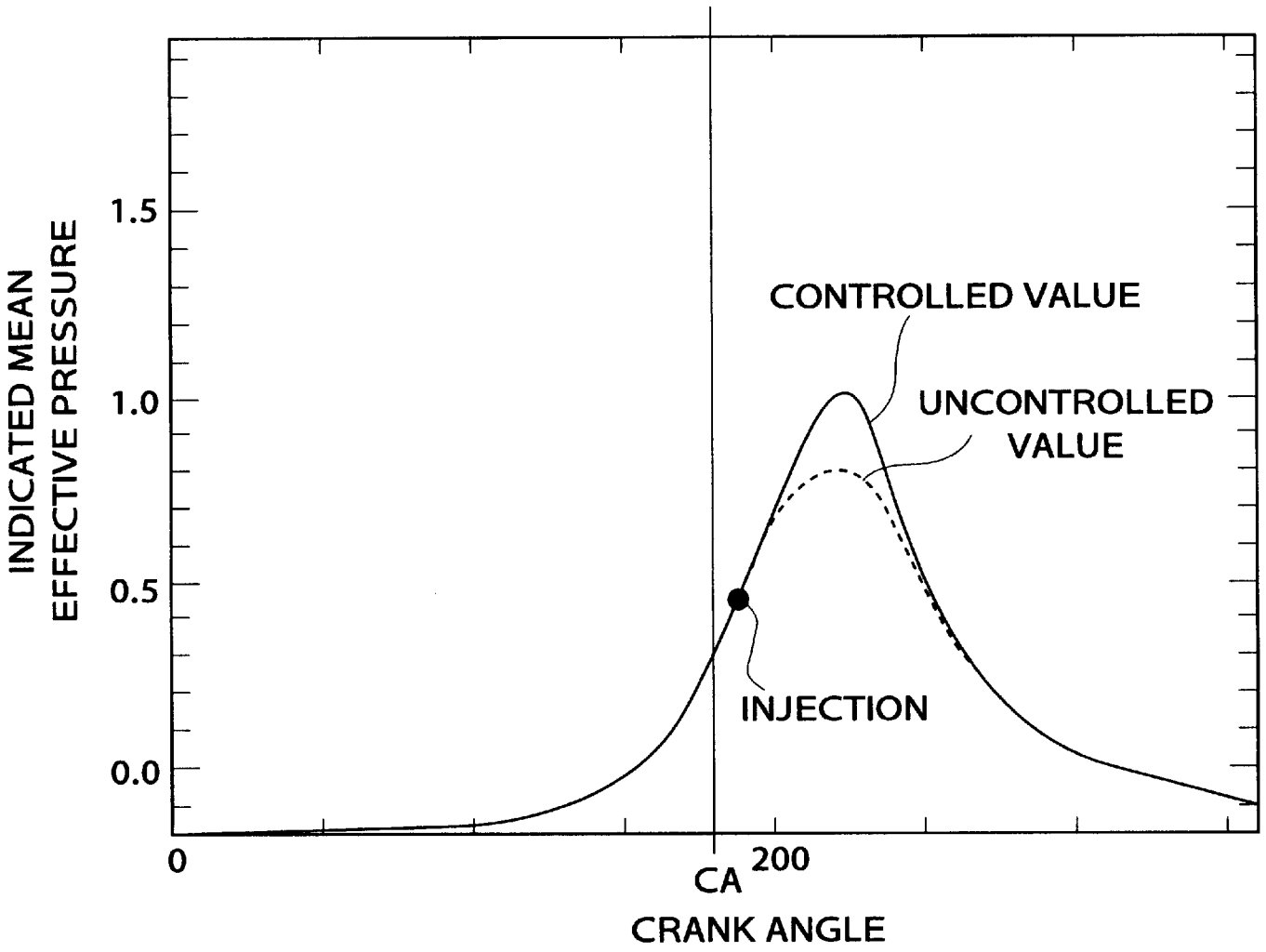
FIG. 8 is a graph showing the relationship between a crank angle and indicated mean effective pressure.

The fuel injection valve 2 is controlled to start fuel injection at the injection stage determined at the step S4, based on the above calculated desired fuel injection amount QM, to directly inject fuel into the combustion chamber. FIG. 8 shows the relationship between the indicated mean effective pressure and the crank angle, which is useful in explaining effects obtained by the above described control of the fuel injection amount based on the heat flux. In the figure, the black dot represents the fuel injection timing.

As stated above, when the detected heat flux is large, it can be considered that a large amount of residual gases which have not been burned in the last combustion cycle remains within the combustion chamber and hence the combustion efficiency is degraded in the present combustion cycle. Therefore, by controlling the fuel injection amount, based on the detected heat flux, in the same stroke (the latter half of the compression stroke of the present combustion cycle) as the stroke in which the heat flux has been detected (the former half of the compression stroke of the present combustion cycle), the combustion efficiency can be enhanced with good responsiveness to the amount of residual gases remaining within the combustion chamber. That is, if the injection amount control based on the heat flux is carried out, as indicated by a solid line in FIG. 8, the indicated mean effective pressure during combustion becomes higher than a value assumed when the injection amount control is not carried out, as indicated by a broken line in FIG. 8.

In the present embodiment, as above described, the desired fuel injection amount QM is corrected according to the heat flux within the combustion chamber, but this is not limitative. The fuel injection timing may be corrected according to the heat flux in place of or in addition to the correction of the desired fuel injection amount.

Figure 10:
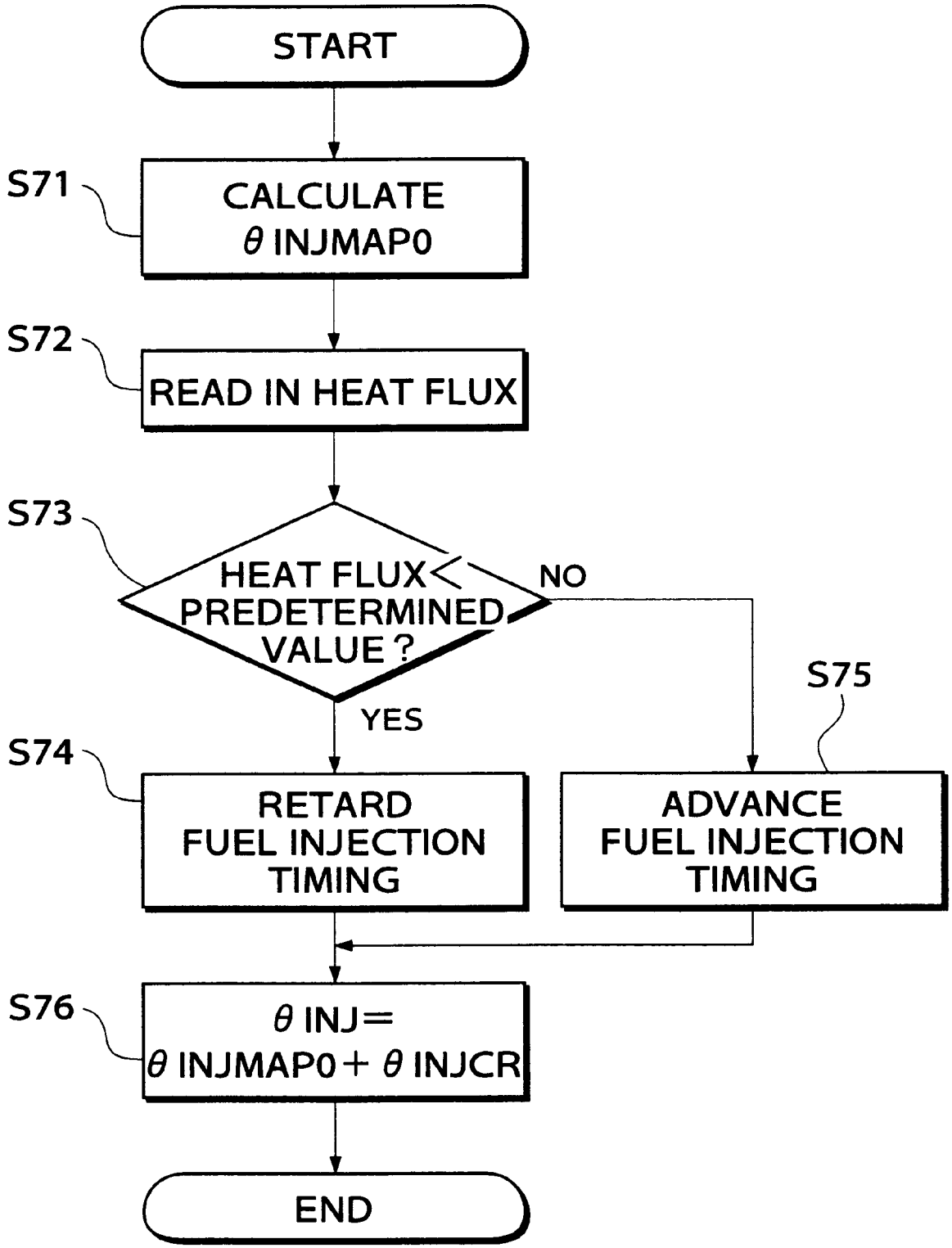
FIG. 10 is a flowchart showing a routine for correcting fuel injection timing according to the heat flux, according to a second embodiment of the invention.

FIG. 10 shows a routine for correcting the fuel injection timing according to the heat flux, according to a second embodiment of the invention. The hardware construction of the engine and the control system therefor according to the second embodiment is identical with that of the first embodiment.

First, at a step S71, the ECU 6 determines a basic injection stage θINJMAP0 at which the fuel injection is to be started, from a θINJMAP0 map, not shown. The θINJMAP0 map is provided with map values of the basic fuel injection stage θINJMAP0 arranged in the form of a matrix, according to predetermined values of the engine rotational speed NE and predetermined values of the accelerator pedal position θACC.

The map values of the θINJMAP0 map are set such that the fuel injection is started at a stage within the crank angle range between BTDC20° and ATDC5° with respect to the TDC position corresponding to the termination of the compression stroke in which good exhaust emission characteristics are obtained and desired stratified combustion can take place within the combustion chamber in every load region of the engine. This is because crank angle stages within the range between BTDC20° and ATDC5° are the optimum for the fuel injection timing to satisfy both good exhaust emission characteristics and good fuel economy.

At a step S72, the heat flux is detected by the heat flux sensor 18 and read in, in synchronism with generation of a CRK signal pulse at one of the stages within the predetermined crank angle range from the latter half of the exhaust stroke in the last combustion cycle to the first half of the compression stroke in the present combustion cycle, similarly to the calculation of the desired fuel amount QM in the first embodiment. Then, it is determined at a step S73 whether or not the read heat flux is smaller than a predetermined value. If the heat flux is smaller than the predetermined value, a correction variable θINJCR for the fuel injection timing is set to such a value as retards the fuel injection timing at a step S74.

On the other hand, if the heat flux is larger than the predetermined value, the correction variable θINJCR of the injection timing is set to such a value as advances the injection timing at a step S75.

Then, at a step S76, the ECU6 calculates a injection stage θINJ by adding the correction variable θINJCR to the basic injection stage θINJMAPO, by the use of the following equation (2):

$$\theta INJ=\theta INJMAPO+\theta INJCR \quad (2)$$

As described above, according to the second embodiment, by correcting the fuel injection timing to a retarded side or an advanced side according to the heat flux, the combustion efficiency can be improved. The predetermined value is preferably set to an average value of the heat flux reflecting characteristics of the engine, which has been detected by a test, etc., similarly to the first embodiment.

Next, a third embodiment of the invention will be described with reference to FIG. 11. In the first embodiment described above, the optimum combustion efficiency is obtained by controlling the fuel injection amount according to the heat flux, but in the third embodiment, the ignition timing of the engine is controlled in place of controlling the fuel injection amount. The hardware construction of the engine and the control system therefor according to the third embodiment is identical with that of the first embodiment.

Figure 11:
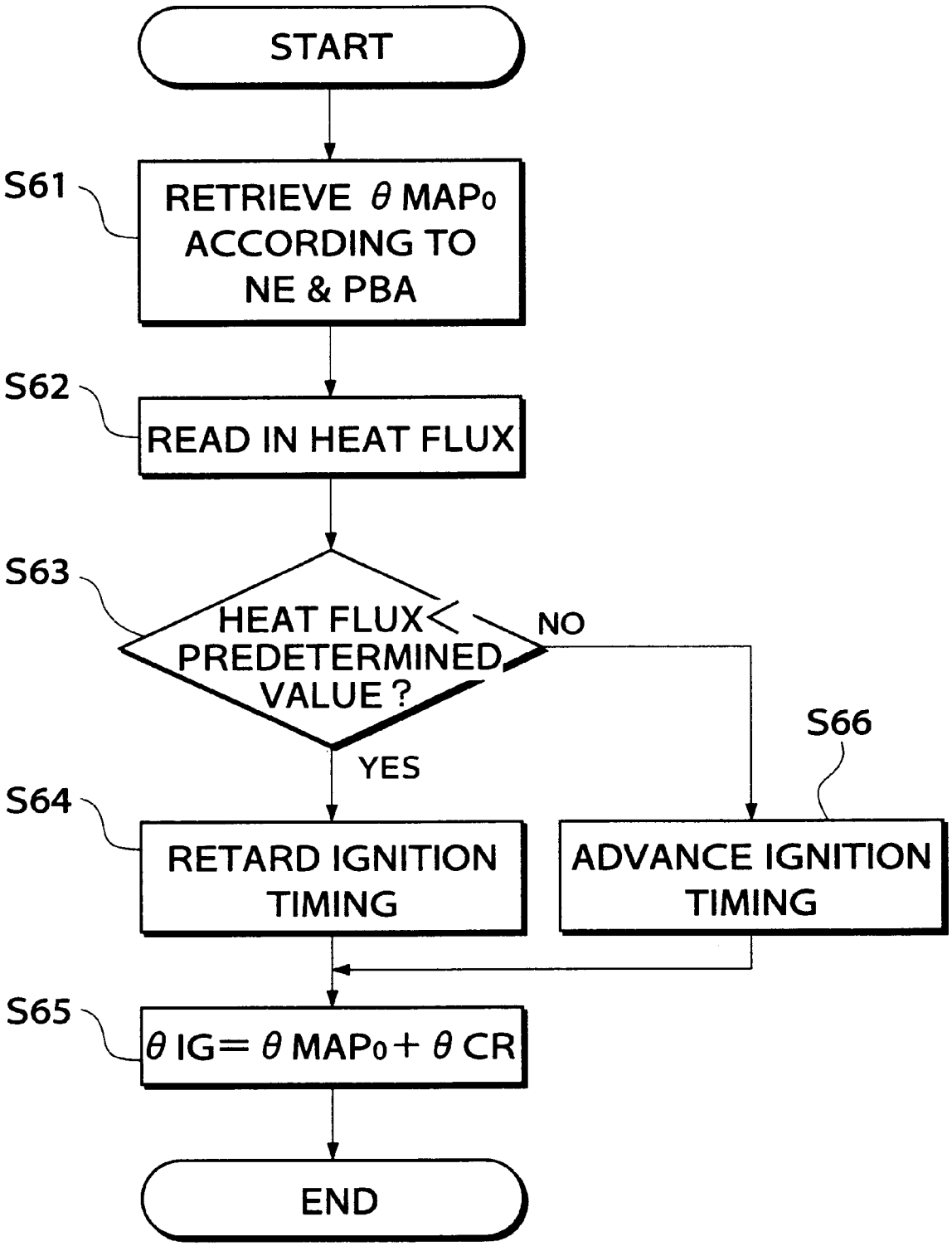
FIG. 11 is a flowchart showing a routine for correcting ignition timing θIG according to the heat flux, according to a third embodiment of the invention.

FIG. 11 shows a routine for calculating the ignition timing θIG according to the third embodiment. The ignition timing θIG is calculated, similarly to the first embodiment, based on the heat flux detected in the crank angle range from the latter half of the exhaust stroke in the last combustion cycle to the first half of the compression stroke in the present combustion cycle (see FIG. 7).

First, at a step S61, the ECU 6 determines the basic ignition timing θMAP0 from a θMAP0 map, not shown, according to the engine rotational speed NE and the intake pipe absolute pressure PBA. The θMAP map is provided with map values of the basic ignition timing θMAP0 arranged in the form of a matrix, according to predetermined values of the engine rotational speed NE and predetermined values of the intake pipe absolute pressure PBA. The basic ignition timing θMAP0 may be calculated by another routine executed in synchronism with generation of TDC-determining signal pulses, by reading a θMAP0 value from a memory in which θMAP values are stored.

At a step S62, the heat flux is detected by the heat flux sensor 18 and read in, in synchronism with generation of a CRK signal pulse at one of the stages within the predetermined crank angle range mentioned above. Then, it is determined at a step S63 whether or not the read heat flux is smaller than a predetermined value. If the heat flux is smaller than the predetermined value, a correction variable θCR for the ignition timing is set to such a value as retards the ignition timing at a step S64. The predetermined value is preferably set, similarly to the first embodiment, to an average value of the heat flux reflecting characteristics of the engine, which has been detected by a test, etc.

On the other hand, if the heat flux is larger than the predetermined value, the correction variable θCR is set to such a value as advances the ignition timing at a step S66.

The ECU 6 calculates the ignition timing θIG by adding the correction coefficient θCR to the basic ignition timing θMAP0 at a step S65, by the use of the following equation (3):

$$\theta IG=\theta MAP0+\theta CR \quad (3)$$

As described above, according to the third embodiment, when the heat flux is large, it can be considered that a large amount of residual gases which have not been burned in the last combustion cycle remains within the combustion chamber and hence the combustion efficiency is degraded in the present combustion cycle. Therefore, by advancing or retarding the ignition timing in the same stroke as the stroke in which the heat flux is detected, to thereby improve the combustion efficiency with good responsiveness to the amount of residual gases remaining within the combustion chamber.

The above control of the ignition timing based on the heat flux is applicable not only to direct injection-type internal combustion engines but also applicable to premix injection-type internal combustion engines in which fuel is injected into the intake pipe. Further, if the invention is applied to a direct injection-type engine, both the control of the ignition timing and the control of the fuel amount and/or the fuel injection timing can be used.

Further, the present invention is applicable not only to control of the fuel injection amount, fuel injection timing and ignition timing as employed in the first to third embodiments, but also to control of the exhaust gas recirculation amount based on the heat flux. In such a case, the maximum fuel injection amount and/or the fuel injection timing may be controlled with respect to the exhaust gas recirculation amount. Further, the exhaust gas recirculation amount may be controlled cylinder by cylinder.

Still further, when the invention is applied to an internal combustion engine having a valve timing control system for intake valves and exhaust valves, the valve timing may be changed according to the heat flux.

What is claimed is:

1. In a control system for an internal combustion engine having at least one combustion chamber and a plurality of cylinders, including heat flux-detecting means arranged in said combustion chamber, for detecting heat flux within said combustion chamber, fuel control means for controlling at least one of an amount of fuel supplied to said engine and fuel injection timing according to operating conditions of said engine, and ignition timing control means for controlling ignition timing of said engine according to operating conditions of said engine, the improvement wherein:

said heat flux-detecting means detects said heat flux at timing within a range from a latter half of an exhaust stroke of each of said cylinders of a combustion cycle of said engine to a first half of a compression stroke of said each cylinder of a following combustion cycle of said engine; and said control system comprises correcting means for correcting at least one of said amount of fuel controlled by said fuel control means, said fuel injection timing controlled by said fuel control means, and said ignition timing controlled by said ignition timing control means, based on said heat flux detected by said heat flux-detecting means, in the same stroke as said compression stroke of said following combustion cycle in which said heat flux has been detected.

2. A control system as claimed in claim 1, wherein said engine has a crankshaft, said fuel control means setting said fuel injection timing to timing within a crank angle range between 20° before a top dead point corresponding to termination of said compression stroke and 5° after the same.

3. A control system as claimed in claim 1, wherein said engine is an internal combustion engine of a type that fuel is directly injected into said combustion chamber, said correcting means comparing said heat flux detected by said heat flux-detecting means with a predetermined value and correcting said amount of fuel, based on results of the comparison.

4. A control system as claimed in claim 1, wherein said engine is an internal combustion engine of a type that fuel is directly injected into said combustion chamber, said correcting means comparing said heat flux detected by said heat flux-detecting means with a predetermined value and correcting said fuel injection timing, based on results of the comparison.

5. A control system as claimed in claim 3, wherein said correcting means increases said amount of fuel when said heat flux detected by said heat flux-detecting means is larger than said predetermined value.

6. A control system as claimed in claim 3, wherein said correcting means decreases said amount of fuel when said heat flux detected by said heat flux-detecting means is smaller than said predetermined value.

7. A control system as claimed in claim 4, wherein said correcting means advances said fuel injection timing when said heat flux detected by said heat flux-detecting means is larger than said predetermined value.

8. A control system as claimed in claim 4, wherein said correcting means retards said fuel injection timing when said heat flux detected by said heat flux-detecting means is smaller than said predetermined value.

9. A control system as claimed in claim 1, wherein said correcting means compares said heat flux detected by said heat flux-detecting means with a predetermined value and advances said ignition timing when said heat flux detected by said heat flux-detecting means is larger than a predetermined value.

10. A control system as claimed in claim 1, wherein said correcting means compares said heat flux detected by said heat flux-detecting means with a predetermined value and retards said ignition timing when said heat flux detected by said heat flux-detecting means is smaller than a predetermined value.

11. A control system as claimed in claim 2, wherein said engine is an internal combustion engine of a type that fuel is directly injected into said combustion chamber, said correcting means comparing said heat flux detected by said heat flux-detecting means with a predetermined value and correcting said fuel injection timing, based on results of the comparison.

12. A control system as claimed in claim 3, wherein said engine is an internal combustion engine of a type that fuel is directly injected into said combustion chamber, said correcting means comparing said heat flux detected by said heat flux-detecting means with a predetermined value and correcting said fuel injection timing, based on results of the comparison.

* * * * *